US005562052A

United States Patent [19]

Glashouwer et al.

[11] Patent Number: 5,562,052

[45] Date of Patent: Oct. 8, 1996

[54] HEIGHT-ADJUSTABLE TABLE

[75] Inventors: Paul A. Glashouwer, Byron Center; Roque M. Corpuz, Jr., Grand Rapids; Brian D. T. Alexander, Fennville, all of Mich.

[73] Assignee: Haworth, Inc., Holland, Mich.

[21] Appl. No.: 459,329

[22] Filed: Jun. 2, 1995

[51] Int. Cl.[6] ..... A47B 9/00

[52] U.S. Cl. ..... 108/144; 108/1; 248/188.5

[58] Field of Search ..... 108/144, 146, 108/155, 10, 1, 96, 106, 110; 248/188, 188.5

[56] References Cited

U.S. PATENT DOCUMENTS

| | | | |
|---|---|---|---|
| D. 114,203 | 4/1939 | Wright . | |
| D. 184,530 | 3/1959 | McCarthy et al. . | |
| 3,410,232 | 11/1968 | Krueger | 108/144 X |
| 3,915,102 | 10/1975 | Barron | 108/144 |
| 4,216,933 | 8/1980 | Cramer | 248/188.5 |
| 5,016,893 | 5/1991 | Hart, Jr. | 248/439 X |

FOREIGN PATENT DOCUMENTS

| | | | |
|---|---|---|---|
| 2700680 | 7/1994 | France | 108/144 |
| 608641 | 1/1935 | Germany | 108/153 |

OTHER PUBLICATIONS

"Wright Now" article, by Pietro Borretti, FDM Furniture Design & Manufacturing, Mar. 1994, (4 pages).

*Primary Examiner*—Peter M. Cuomo
*Assistant Examiner*—Janet M. Wilkens
*Attorney, Agent, or Firm*—Flynn, Thiel, Boutell & Tanis, P.C.

[57] ABSTRACT

A table having a top supported by a leg structure which projects downwardly from the underside of the top. The leg structure including right and left leg arrangements secured under the table adjacent opposite ends thereof, each leg arrangement including a bottom leg part which includes parallel and upright lower front and rear leg members rigidly joined together by a plurality of vertically spaced and horizontally extending cross rods. The front and rear leg members have upper portions telescopically received within individual front and rear upper leg parts, which upper leg parts and lower leg members have a series of cooperating holes which accommodate a removable locking element to permit telescopic height adjustment. The upper leg parts have transversely extending upper tubular portions which project longitudinally of the table under the undersurface of the top. These upper tubular portions are oriented so that the front and rear upper leg parts each have the upper tubular portions aligned and rigidly joined to elongate front and rear tubes extending therebetween directly adjacent the undersurface of the top adjacent the front and rear edges respectively. These support tubes in turn are rotatably positioned within brackets which are fixed to the underside of the top and enables the adjusted height of the front and rear leg arrangements to be slightly different.

7 Claims, 5 Drawing Sheets

FOLDING TABLE LEG CONSTRUCTION

BACKGROUND OF THE INVENTION

The present invention relates to tables, and in particular to a table including folding legs movable between a secure extended position for use and a compact folded position to facilitate storage.

Tables are often provided with folding legs that move between an extended position and a folded position to facilitate set-up, tear-down, shipment and storage. A latching mechanism is usually provided on the folding legs to hold the legs in the extended position so that they do not accidentally unexpectedly collapse during use. However, many latching mechanisms are unsightly and less than attractive. Also, the latching mechanisms can be difficult and/or awkward to operate, or do not retain the legs in the extended position as securely as desired. Aside from the problems of latching mechanisms, it is desirable to fold the legs flat against the tabletop to provide a minimum thickness to facilitate storage. This is a problem where a pair of opposing folding legs on a table each include a transverse member near the bottom of the legs and the legs are so long that they overlap at the bottom when in the folded position. The overlapping legs not only damage and scratch each other, but also the legs are prevented from laying flat against the tabletop, thus requiring additional storage space. As a result, in many known tables having folding legs, the folded position of the legs at least partially dictates the style and design of the legs.

Thus, an improved table including latchable folding legs solving the aforementioned problems is desired. Also, a hinge arrangement is desired which is easily assembled to a tabletop, which maximizes efficient use of the space under the tabletop, and which also facilitates movement of the legs into and out of the folded position.

SUMMARY OF THE INVENTION

One aspect of the present invention includes a table having a tabletop, and a folding leg movably connected to the tabletop by a linkage arrangement for movement between an extended position for supporting the tabletop and a folded position for storage. The linkage arrangement includes a U-shaped link, and a releasable center latch is provided for releasably engaging the U-shaped link to stabilize the folding leg when in the folded position. In the preferred embodiment, the linkage arrangement forms a four-bar linkage defining four axes of rotation, and at least one of the axes of rotation is offset from a plane connecting the two axes fixed relative to the tabletop so that the links do not tend to lock up in an "on center" or "over center" relationship when in the folded position. Thus, the folding leg can be readily moved from the folded position.

These and other features and advantages of the present invention will be further understood and appreciated by those skilled in the art by reference to the following specification, claims and appended drawings.

BRIEF DESCRIPTION OF THE DRAWINGS

FIGS. 10–12 are orthogonal views of the U-shaped link shown in FIG. 5;

FIG. 13 is perspective view of the latch housing shown in FIG. 5;

FIG. 14 is a cross-sectional view taken along the plane XIV—XIV in FIG. 13;

FIG. 15 is an enlarged side cross-sectional view of the releasable latch taken along the plane XV—XV in FIG. 5, the base plate and tabletop being shown in phantom; and FIGS. 16–19 are side views showing a leg being moved from a folded position (FIG. 16) to an extended and nearly latched position (FIG. 19).

DETAILED DESCRIPTION OF PREFERRED EMBODIMENT

Figure 2:
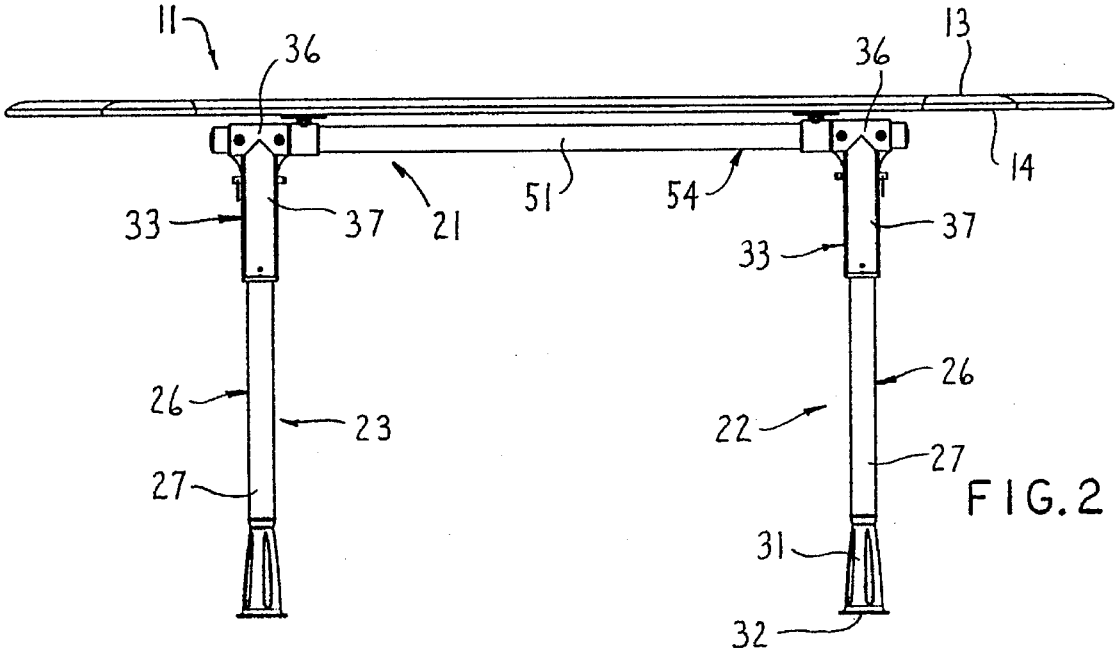
FIG. 2 is an end view of the table shown in FIG. 1.

For purposes of description herein, the terms "upper," "lower," "right," "left," "rear," "front," "vertical," "horizontal" and derivatives thereof shall relate to the invention as oriented in FIG. 2, the front of the table being toward the left of the page. However, it is to be understood that the invention may assume various alterative orientations, except where expressly specified to the contrary. It is also to be understood that the specific drawings and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
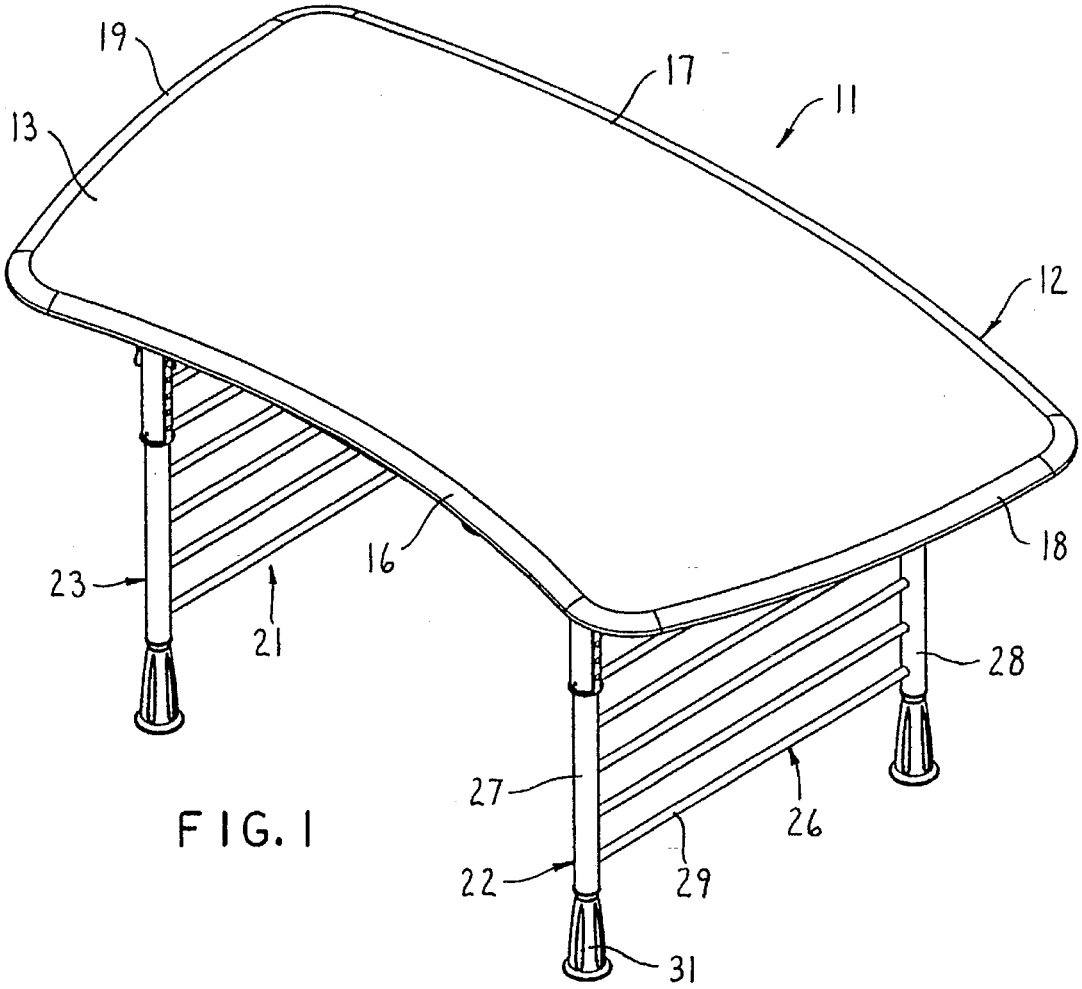
FIG. 1 is a perspective view of a table including folding legs embodying the present invention.

A table 30 (FIG. 1) embodying the present invention includes a tabletop 32 and a pair of folding leg assemblies 33 secured to the bottom surface of tabletop 32. Leg assemblies 33 (FIG. 2) each include a leg supporting base plate 34, and a folding leg 36 movably connected to base plate 34 by a "four bar" linkage arrangement including links 38 and 40. Links 38 and 40 are pivotally connected to base plate 34 and to leg 36 at separated axes A1–A4 (FIG. 3) such that the upper portion 46 of leg 36 swings toward an edge 48 of tabletop 32 as leg 36 is moved from an extended position (see FIGS. 1–4) to a folded position (FIG. 16). This movement improves the utilization of space under the table 30, so that inverted Y-shaped collapsible legs 36 having a transverse floor engaging member 52 at their lower end can be used without transverse member 52 overlapping onto an adjacent leg 36. A latch 54 (FIG. 5) is attached to base plate 34, and link 40 includes a transverse section 56 that frictionally engages latch 54 when in the extended position to increase the stability of legs 36 when table 30 is in use. Axes A1–A4 (FIG. 16) are offset from each other so that they cannot be moved to an "over center" or "on center" position when legs 36 are in the folded position. This prevents a lock up condition and thus facilitates moving the legs 36 from the folded position to the extended position.

Tabletop 32 (FIG. 1) is generally planar and rectangular, although different shapes and sizes can be used. Tabletop 32 includes an edge 48 extending around the perimeter of tabletop 32, and a bottom surface 50.

Folding legs 36 (FIGS. 2–3) have an inverted Y-shaped construction and include a pair of beam-like weight bearing tubular members 51 interconnected at the bottom by transverse arcuately-shaped floor-engaging member 52. Weight bearing members 51 have an elliptical tubular cross section which provides aesthetics and also adds strength to leg 36. The lateral spacing of tubular members 51 and the span of transverse floor engaging member 52 also add stability to the overall structure. Transverse member 52 rigidly interconnects weight bearing members 51, and it is contemplated that additional transverse members can be added to further rigidify leg 36 if desired. A pair of caps 57 made of a molded material are secured to the ends of transverse floor engaging member 52 to prevent damage to the floor/support surface that supports table 30. Also, caps 58 (FIGS. 4–5) are secured to the upper end of tubular members 51 for engaging base plate ears 74A. Cap 58 prevents undesirable wear and/or noise as tabletop 32 shifts relative to legs 36 during use. Legs 36 have an inverted Y-shaped construction for aesthetics and optimal stability, however the present invention is contemplated to include alterative leg constructions. It is noted that the present hinge arrangement is particularly suited for securing legs which cannot overlappingly mateably fold into each other as the legs are moved to the folded position adjacent bottom surface 50 of tabletop 32.

Figure 7:
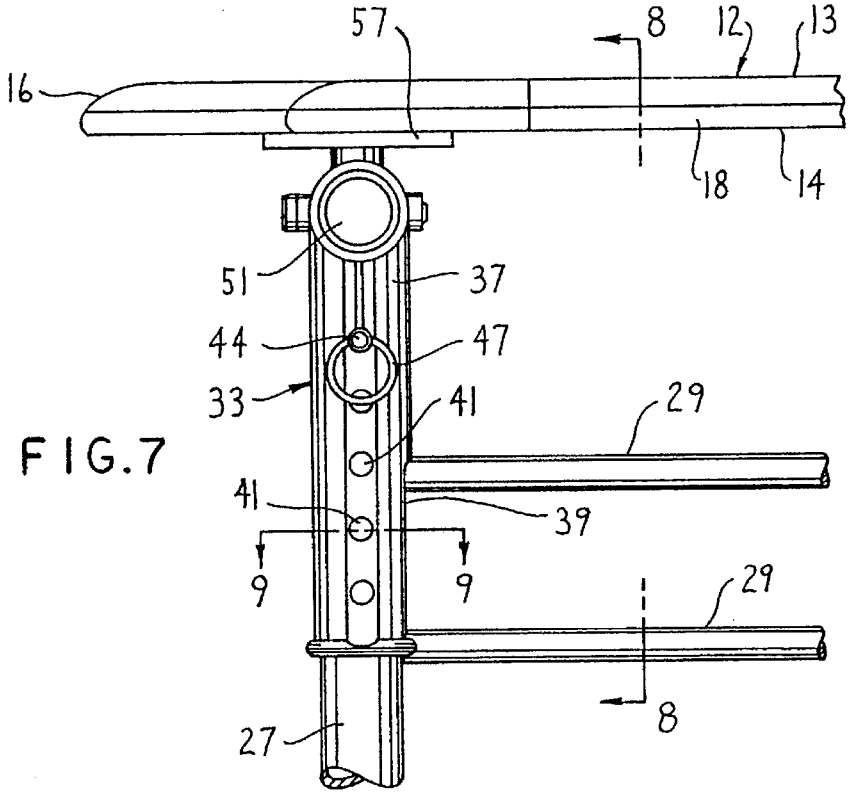
FIG. 7 is a side view of the base plate shown in FIG. 6.

Base plate or bracket 34 (FIG. 7) includes a planar tabletop-engaging section 60 for stably engaging the bottom surface 50 (FIG. 5) of tabletop 32. Holes 62 are provided in planar section 60 for receiving screws 64 to secure base plate 34 to tabletop 32, although it is noted that other fastening mechanisms can be used. The dimensions of planar section 60 are chosen based on the width of tubular members 51 in legs 36, the functional requirements of table 30 and the strength of the material comprising tabletop 32 and legs 36. Pivot forming flanges 66 and 68 (FIG. 7) are located at the corners of planar section 60 and extend perpendicularly downwardly from tabletop 32. Gussets 71 are formed at the juncture of planar section 60 and flanges 66 and 68 to strengthen and stabilize flanges 66 and 68. Holes 67 and 69 are located in flanges 66 and 68, respectively, for receiving pivot pins 70 and 72 (FIG. 5) to pivotally connect links 38 and 40 to base plate 34. Holes 67 and 69 define the first and second axes of rotation "A1" and "A2" for links 38 and 40, as discussed below. Planar section 60 includes ears 74A that engage the two caps 58 at the upper ends of tubular members 51 when leg 36 is in the extended position. Cutouts 78, 79 and 80 are located around the perimeter of planar section 60 as desired to reduce weight. Also, the cutouts 78, 79 and 80 provide a distinctive attractive appearance.

Four integral tabs 82–85 (FIGS. 6–9) are formed from the material in the center of planar section 60. Tabs 82–85 form a rectangular pattern for holding latch 54. Tabs 82 and 83 are located in opposing spaced apart relationship between the edges of tabs 84 and 85. Tab 84 includes a square hole 86 and tab 85 includes a round hole 87 which cooperate with latch 54, as described below.

Figure 5:
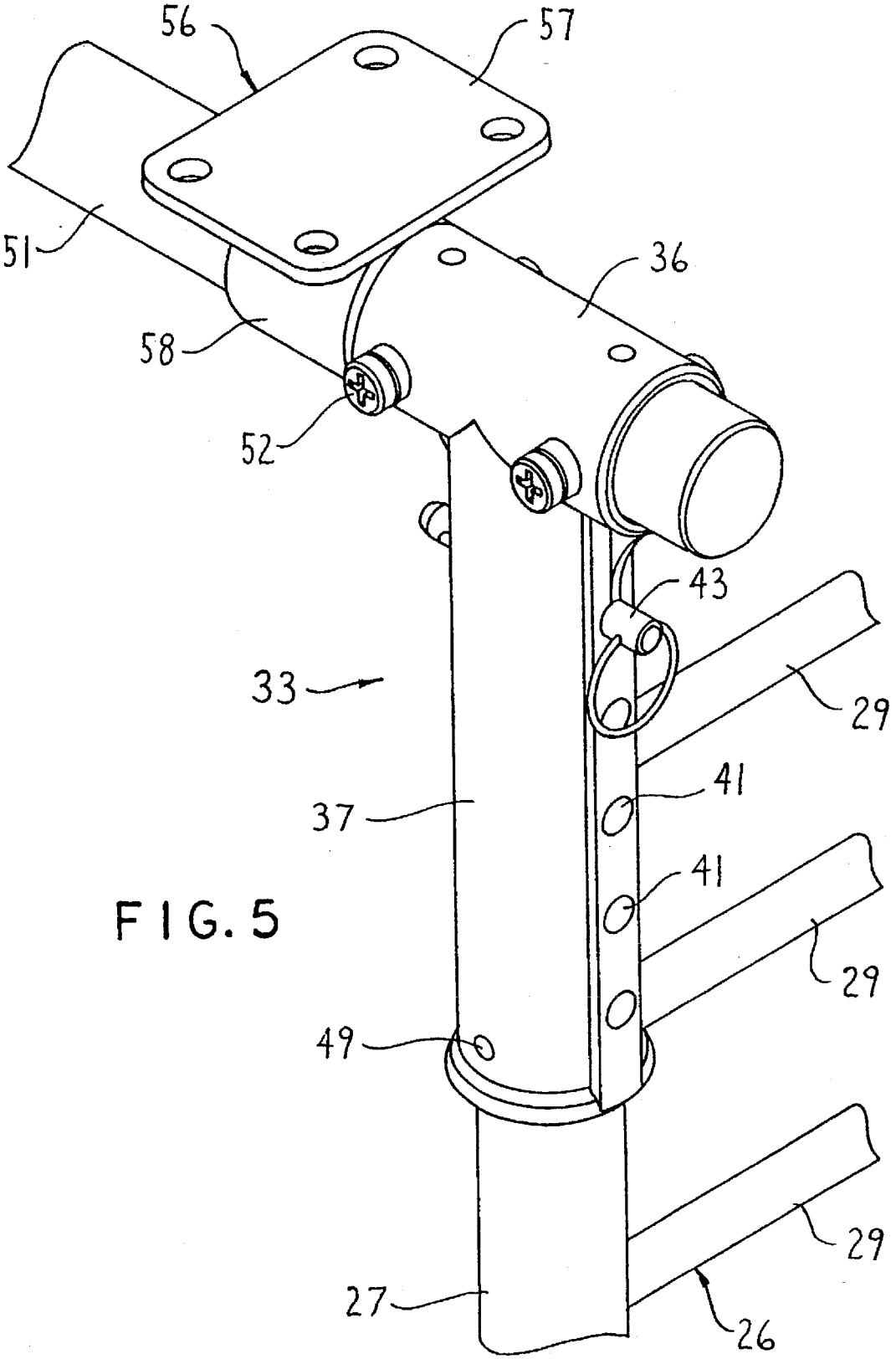
FIG. 5 is a fragmentary bottom cross-sectional view of the folding leg and the hinge arrangement shown in FIG. 4.

There are two links 38 and one link 40 in each folding leg assembly 33 (FIG. 5). Links 38 are planar and include holes at each end and are pivotally attached to base plate flange 66 by pivot pin 70 and to table leg 36 by pivot pin 71. Pivot pin 71 defines the third axis of rotation "A3". Link 40 (FIGS. 10–12) is U-shaped and includes side sections 88 interconnected by the transverse section 56. Gussets 91 are formed on the corners connecting sections 88 and 56 to stabilize the sections relative to each other. Side sections 88 include pivot forming holes 92 and 94. Pivot pin 72 pivotally engages pivot forming holes 92 to connect link 40 to the pivot forming flanges 68 on base plate 34 and pivot pin 74 (FIG. 18) pivotally engages pivot forming holes (94) on link 40 and securely engages cap 58 on leg 36 to pivotally connect link 40 to leg 36. Pivot pin 74 defines the fourth axis of rotation "A4". A square hole 96 is formed in transverse section 56 for frictional engagement by the tapered end of latch 54. The free ends 97 (FIG. 11) of side sections 88 are rounded to facilitate the pivoting motion of link 40 as leg 36 is moved between the folded position and the extended position.

Latch 54 (FIG. 15) includes a cup-shaped housing 102 and a latching member 104 slideably positioned in housing 102. Housing 102 (FIGS. 13–14) includes a bottom cover section 106, sidewalls 108 and 109, and an end wall 110 defining a pocket 118. An open end 111 is defined between sidewalls 108 and 109 at one end of housing 102 opposite end wall 110. An intermediate wall 112 extends between sidewalls 108 and 109. A hole 114 is located in intermediate wall 112 for slideably receiving the shaft of latching member 104. An access hole 116 in the bottom cover section 106 allows access to the pocket 118 defined within housing 102, such as for accessing latch member 104 after assembly. Notably, it is contemplated that access hole 116 could be enlarged or expanded into a slot, and a handle (not shown) could be attached to latching member 104 and extended through the slot so that an operator could manually move latching member 104 to a retracted release position against the bias of latch-biasing spring 126, discussed below.

When housing 102 (FIG. 15) is assembled to base plate 34, housing sidewalls 108 and 109 engage the outside surfaces of flanges 82 (and 83) to securely hold latch 54 in a centered position on base plate 34. Also, end wall 110 and intermediate wall 112 are located between and adjacent flanges 84 and 85, respectively. Latching member 104 includes a round shaft section 120 that fits slideably mateably into hole 114 in intermediate wall 112 and further fits slideably mateably into round hole 87 in tab 85. Latching member 104 further includes a square shaft section 122 that mateably engages square hole 86 in tab 84. A shoulder 124 is formed at the juncture of shaft sections 120 and 122. A coil spring 126 positioned on round shaft section 122 is compressed between tab 85 and shoulder 124. Spring 126 biases latching member 104 toward engagement with transverse member 56. The free end of round shaft section 120 is configured to receive a washer 128 and cotter pin 130 to securely hold latching member 104 on intermediate wall 112. Notably, washer 128 and cotter pin 130 are assembled through the aperture 132 (FIG. 6) in base plate 34 adjacent tab 85.

The caps 58 (FIG. 18) on the upper end of leg weight bearing members 51 include an end forming section of material 134 for abuttingly engaging ears (74) on the bottom of tabletop 32. Inner and outer tube engaging sections 136 and 138 extend from end forming section 134, and define a groove therebetween for mateably receiving the end of tubular weight bearing member 51. Caps 58 are press-fit onto weight bearing members 51 and frictionally retained thereon, although it is within the present invention to also include other retention means such as fasteners or adhesives.

Pivot forming holes 140 (FIG. 18) are located in end forming section 134 in a position offset from the longitudinal center line 142 defined by weight bearing members 51. When leg 36 is in the folded position (FIG. 16), holes 140 tubular cross pieces 36 of the rear top leg members 34 as disposed adjacent the rear corners of the top, with this rear support tube 51 also being suitably fixed to the rear top leg members in the same fashion described above. This rear support rod 53 extends generally parallel with the front support rod 51 and is also disposed closely adjacent the undersurface of the top in close proximity to but spaced slightly forwardly from the rear edge 17 of the top.

The front support rod 51 and its fixed securement at opposite ends thereof to the front top leg members 33 results in the defining of a generally rigid top leg unit 54 which is of a generally shallow inverted U- or channel-shaped configuration disposed within a generally vertical longitudinally extending plane. The rear support rod 53 and its securement to the two rear top leg members 34 defines a similar rigid top leg unit of inverted channel-shaped configuration.

The front and rear inverted channel-shaped top leg units 54 thus cooperate with the right and left base leg units 26 to define the overall leg structure for the table. The opposite ends of the front top leg unit 54 thus has the top leg parts 37 thereof disposed in telescopic and supported engagement with upper portions of the front base leg parts 27 associated with the right and left base units 26. In a similar fashion, the rear top leg unit 54 at opposite ends has its top leg parts 37 disposed in telescopic and supported engagement with upper portions of the rear leg parts 28 associated with the right and left base units 26. This cooperation results in the overall leg structure itself, when assembled as summarized above, being a freestanding and self-supporting structure, irrespective of whether the top 12 is mounted thereon.

To secure the leg structure to the top 12, each of the support tubes 51 and 53 has at least two securing brackets 56 associated therewith, adjacent opposite ends or portions of the respective support tube, for securement of respective support rod portions to the top 12. As illustrated by FIGS. 5–8, each securing bracket 56 includes a securing plate 57 which is adapted to be disposed in engagement with the undersurface 14 of the top, which securing plate has suitable openings therethrough for accommodating appropriate fasteners (not shown) for rigid securement to the top 12. The securing bracket 56 also includes a support sleeve or bearing 58 which is fixedly secured to the bracket plate 57 in slightly downwardly spaced relation therefrom. This support sleeve 58 has a generally cylindrical opening therethrough so as to closely accommodate therein the respective support tube, such as the tube 51. The support of the tube 51 within the support sleeve 58, however, is such as to provide a running clearance in that the cross tube 51, 53 is permitted to rotate about its longitudinal axis within the support sleeve 58.

Figure 6:
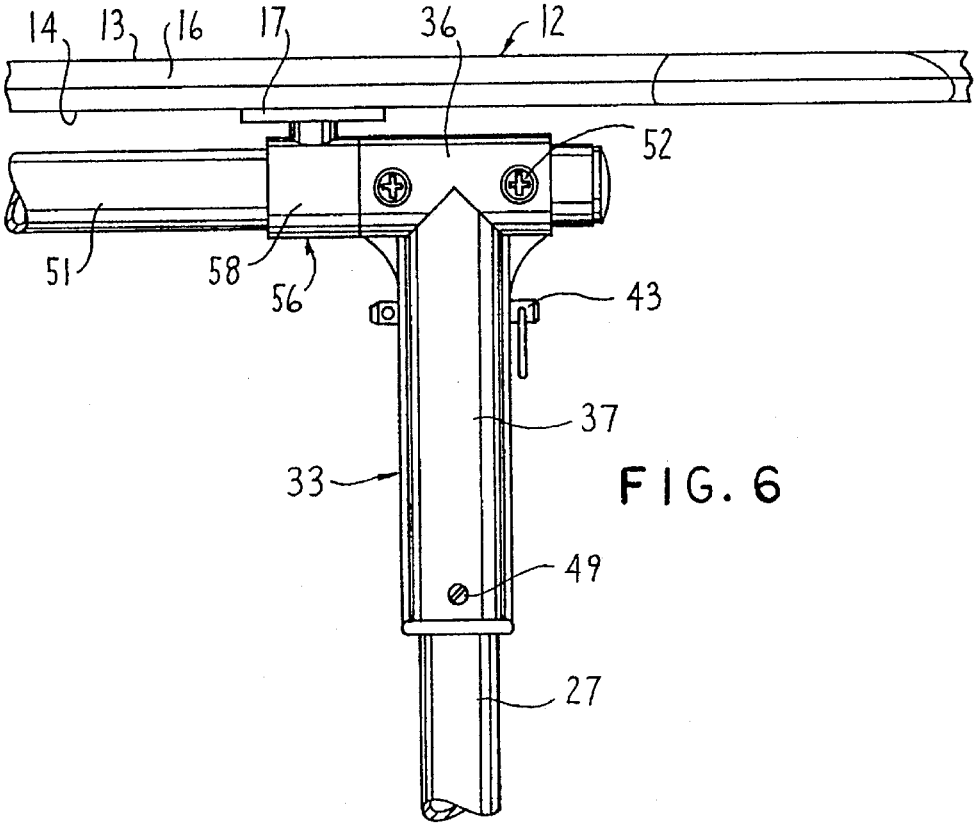
FIG. 6 an enlarged plan view of the leg supporting base plate shown in FIG. 5.
Figure 8:
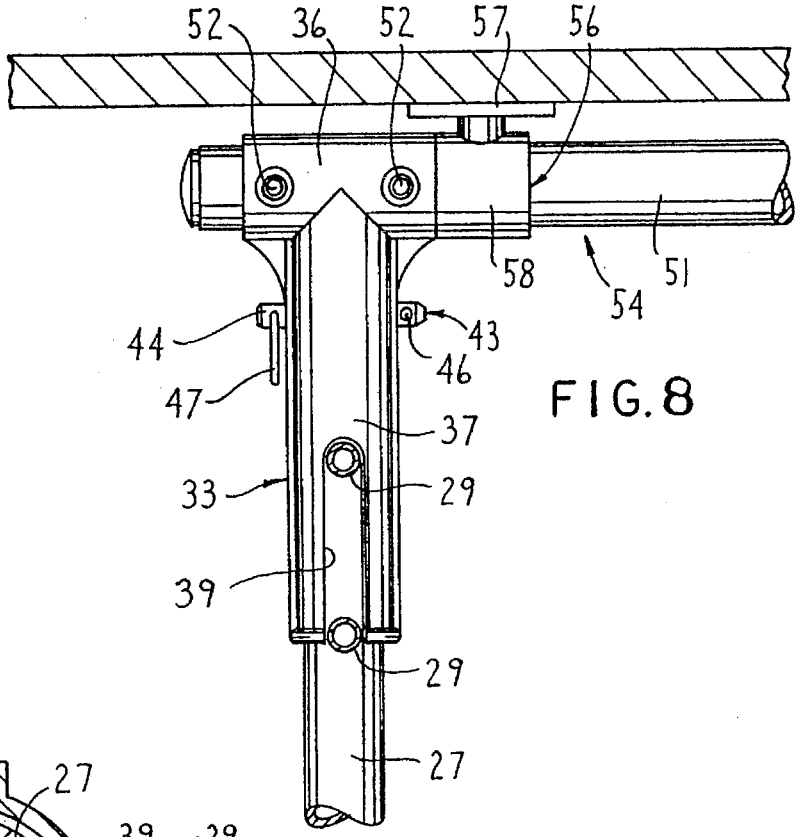
FIGS. 8–9 are cross-sectional views taken along the planes VIII—VIII and IX—IX in FIG. 6.
Figure 9:
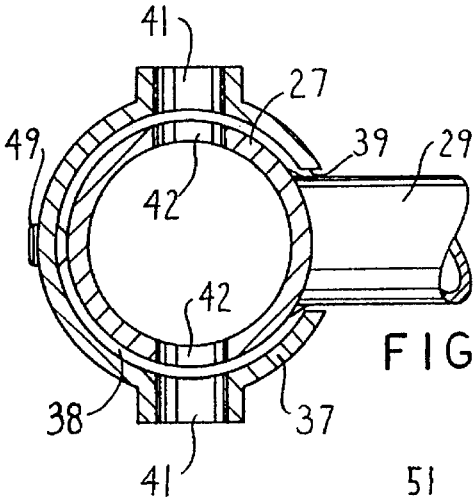

As shown by FIGS. 6 and 8, the securing brackets 56 are preferably positioned so that each is disposed closely adjacent a respective one of the top leg members 33 or 34, with the support sleeve 58 being disposed so as to substantially abut the inner end of the top cross piece 36. This results in the two brackets associated with opposite ends of the respective support rod being disposed closely adjacent and between the upper leg members so as to prevent longitudinal movement of the leg structure relative to the top.

The height-adjusting function of the table 11 of this invention will now be briefly described.

Figure 3:
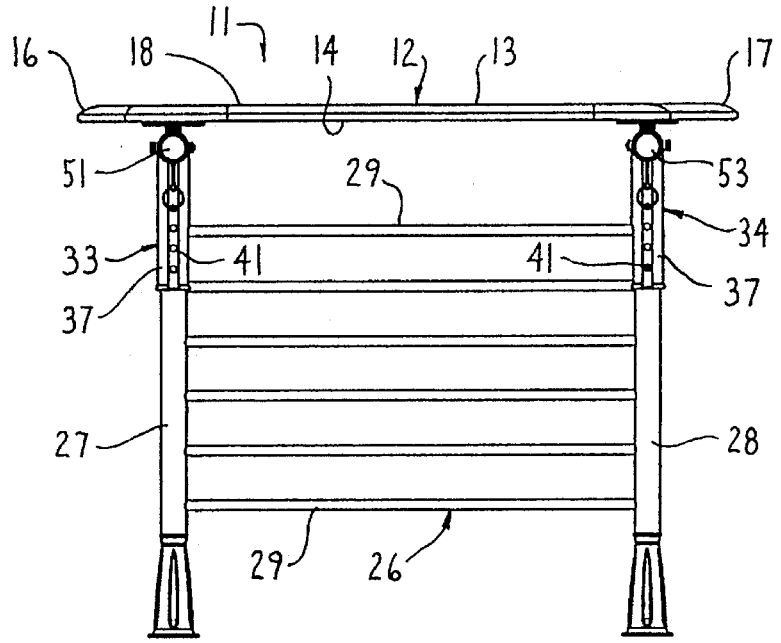
FIG. 3 is a fragmentary side view of the table shown in FIG. 1.
Figure 4:
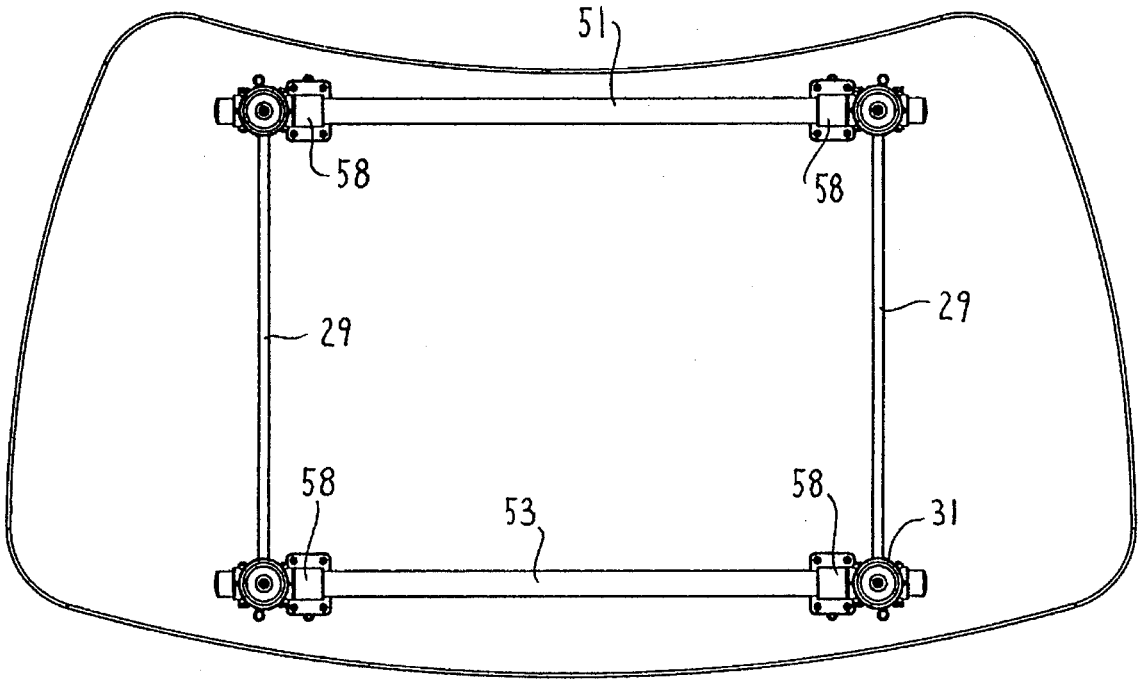
FIG. 4 is an enlarged fragmentary side view of the folding leg and the linkage arrangement shown in FIG. 3, the folding leg being latched in the extended use position.

In normal usage, the table will typically be utilized with the top 12 in a horizontal orientation substantially as illustrated by FIG. 3. In this orientation, both the front and rear leg parts of the right and left leg arrangements will both be adjusted to the same elevation. To select the desired elevation, the securing pins 43 are manually removed from the telescoped leg parts, and the upper leg parts 37 are telescopically raised or lowered relative to the base parts 27 and 28 until reaching the desired top elevation, at which elevation a slight height adjustment is made until alignment exists between one each of the openings 41 and 42, following which the securing pins are reinserted so as to secure the position of the top at the desired height. When so secured, the set screws 49 are preferably also tightened so as to remove any possible looseness which may exists in the telescopic leg arrangement.

Figure 10:
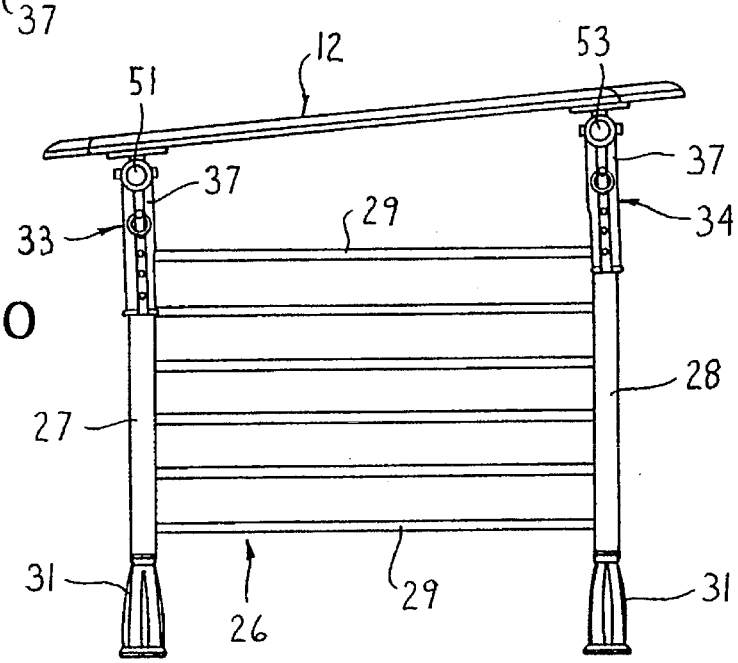

However, this leg structure also permits the top 12 to be adjusted so as to assume a sight inclination relative to the horizontal, as by raising the rear edge relative to the front edge, as illustrated by FIG. 10. If such an inclined orientation of the top is desired in the widthwise direction thereof, then the telescopic rear leg parts are merely adjusted so as to have a height somewhat greater than the telescopic front leg parts, thereby permitting the top to assume the inclined relationship shown by FIG. 10. This possibility of positioning the top 12 in a inclined relationship as illustrated by FIG. 10 is possible since the small clearance 38 provided between the telescoped upper and lower tubular leg parts, coupled with the additional cutaway provided in the inner lower side of the upper leg part 37 due to the presence of the elongate slot 39, enable the upper leg parts associated with one longitudinal edge of the table, such as the rear upper leg parts 34, to assume a slight inclined or angled relationship relative to the respective telescopically engaged lower leg parts 28 which, in conjunction with the ability of the support rods 51 and 53 to rotate within the support sleeves 58, enables the top 12 to be moved into a slightly inclined relationship. This is highly desirable since it enables the user to position the table top in the typical horizontal orientation of FIG. 3, but also enables the user to position the top 12 in a slightly inclined orientation, this often being a highly desirable and comfortable working position. Such slight inclination of the top, which will typically be no more than about 7½° to 10°, thus provides a highly advantageous function, and yet such function is accomplished without requiring any separate or complex tilt mechanism.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a table having a horizontally enlarged top having generally longitudinally extending front and rear edges joined by right and left end edges, and a leg structure fixed to an underside of said top and projecting downwardly therefrom, the improvement wherein said leg structure comprises:

right and left upright leg arrangements disposed under said top respectively in the vicinity of the right and left end edges thereof;

each said leg arrangement including a rigid lower leg unit having generally parallel and vertically extending front and rear elongate lower leg parts rigidly joined together in front-to-rear spaced relation by a cross structure;

said leg arrangement including separate front and rear top leg members each having a vertically elongate tubular leg part which is respectively telescopically engaged over an upper portion of the respective lower leg part;

height-adjusting connecting structure cooperating between each lower leg part and its respective telescopically engaged top leg part, said height adjusting structure including a plurality of vertically spaced openings extending transversely through one of the leg parts and alignable with an opening in the other leg part, and a locking pin being removably positioned within the aligned openings of the telescopically engaged legs parts;

a horizontally elongated front support rod disposed closely adjacent the undersurface of said top in the vicinity of the front edge thereof and projecting longitudinally of the top and having opposite ends thereof joined to the front upper leg members;

a horizontally elongated rear support rod disposed closely adjacent the undersurface of said top in the vicinity of the rear edge thereof and projecting longitudinally of the top and having opposite ends thereof joined to the rear upper leg members, said rear support rod extending generally parallel with but being laterally spaced rearwardly from said front support rod;

bracket means mounted on the undersurface of said top for supporting said front and rear support rods, said support rods and the connection thereof between said brackets and the respective top leg parts permitting limited rotational movement of the top leg parts relative to the top substantially about the longitudinal axis of the respective support rod;

whereby the telescopically engaged rear leg parts can be adjusted to a slightly different height than the telescopically engaged front leg parts so as to position the top at a slight incline in a widthwise direction.

2. The table according to claim 1, wherein the cross structure associated with the lower leg unit includes a plurality of generally parallel and horizontally extending cross rods disposed in vertically spaced relation and extending between and fixedly connected to the front and rear lower leg parts, and wherein the upper leg parts have a vertically elongate slot extending through the side wall thereof and opening upwardly from the lower free end thereof for accommodating at least an uppermost one of said cross rods when said upper and lower leg parts are telescopically engaged.

3. The table according to claim 1, wherein the front and rear support rods have opposite ends thereof fixedly secured to the respective top leg parts, and wherein said securing brackets include sleeve portions which surround and rotatably support the front and rear support rods.

4. The table according to claim 3, wherein the top leg parts have a generally T-shaped configuration and have a top tubular cross piece which supports therein an end portion of the respective support rod.

5. The table according to claim 4, wherein a said securing bracket has the sleeve portion thereof disposed closely adjacent and in substantially aligned and abutting engagement with an inner end of the tubular cross piece associated with each top leg part.

6. The table according to claim 5, wherein the cross structure associated with the lower leg unit includes a plurality of generally parallel and horizontally extending cross rods disposed in vertically spaced relation and extending between and fixedly connected to the front and rear lower leg parts, and wherein the upper leg parts have a vertically elongate slot extending through the side wall thereof and opening upwardly from the lower free end thereof for accommodating at least an uppermost one of said cross rods when said upper and lower leg parts are telescopically engaged.

7. In a table having a horizontally enlarged top having generally longitudinally extending front and rear edges joined by right and left end edges, and a leg structure fixed to an underside of said top and projecting downwardly therefrom, the improvement wherein said leg structure comprises:

right and left upright leg arrangements disposed under said top respectively in the vicinity of the right and left end edges thereof;

each said leg arrangement including a rigid lower leg unit having generally parallel and vertically extending front and rear elongate lower leg parts rigidly joined together in front-to-rear spaced relation by a cross structure; portion of the respective lower leg part;

height-adjusting connecting structure cooperating between each lower leg part and its respective telescopically engaged top leg part, said height adjusting structure including a plurality of vertically spaced openings extending transversely through one of the leg parts and alignable with an opening in the other leg part, and a locking pin being removably positioned within the aligned openings of the telescopically engaged legs parts;

at least two horizontal front support rod portions disposed closely adjacent the undersurface of said top in the vicinity of the front edge thereof and being aligned longitudinally of the top and respectively joined to the front upper leg members;

at least two horizontal rear support rod portions disposed closely adjacent the undersurface of said top in the vicinity of the rear edge thereof and being aligned longitudinally of the top and respectively joined to the rear upper leg members, said rear support rod portions extending generally parallel with but being laterally spaced rearwardly from said front support rod portions;

bracket means mounted on the undersurface of said top for supporting said front and rear support rod portions, said support rod portions and the connection thereof between said brackets and the respective top leg parts permitting limited rotational movement of the top leg parts relative to the top substantially about the longitudinal axis of each of the respective support rod portions;

whereby the telescopically engaged rear leg parts can be adjusted to a slightly different height than the telescopically engaged front leg parts so as to position the top at a slight incline in a widthwise direction.

* * * * *

UNITED STATES PATENT AND TRADEMARK OFFICE

CERTIFICATE OF CORRECTION

PATENT NO. : 5 562 052

DATED : October 8, 1996

INVENTOR(S) : Paul A. Glashouwer et al

It is certified that error appears in the above-indentified patent and that said Letters Patent is hereby corrected as shown below:

Column 8, line 23; before "portion" insert

---said leg arrangement including separate front and rear top leg members each having a vertically elongate tubular leg part which is respectively telescopically engaged over an upper---.

Signed and Sealed this

Eleventh Day of March, 1997

*Attest:*

*Attesting Officer*

BRUCE LEHMAN

*Commissioner of Patents and Trademarks*